US008549670B2

(12) United States Patent
Demus

(10) Patent No.: US 8,549,670 B2
(45) **Date of Patent: *Oct. 8, 2013**

(54) I-POCKET FOR AN ACCESSORY ITEM

(76) Inventor: Roderick Demus, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/172,666

(22) Filed: Jun. 29, 2011

(65) Prior Publication Data

US 2011/0277219 A1 Nov. 17, 2011

Related U.S. Application Data

(63) Continuation-in-part of application No. 11/369,213, filed on Mar. 6, 2006, now Pat. No. 7,992,225.

(51) Int. Cl.
*A41D 27/20* (2006.01)

(52) U.S. Cl.
USPC ..... 2/247

(58) Field of Classification Search
USPC ..... 2/247, 249–254, 69, 94, 108, 115
See application file for complete search history.

(56) References Cited

U.S. PATENT DOCUMENTS

| | | | | |
|---|---|---|---|---|
| 4,825,471 | A * | 5/1989 | Jennings | 2/94 |
| 4,876,724 | A * | 10/1989 | Suzuki | 381/385 |
| 6,691,323 | B2 * | 2/2004 | Widmer | 2/247 |
| 6,810,529 | B1 * | 11/2004 | Reilly et al. | 2/69 |
| 6,826,782 | B2 * | 12/2004 | Jordan | 2/94 |
| 7,992,225 | B2 * | 8/2011 | Demus | 2/247 |

* cited by examiner

*Primary Examiner* — Tejash Patel
(74) *Attorney, Agent, or Firm* — Delphine James

(57) ABSTRACT

The present invention is a securing pocket for attachment to an accessory article that supports a small hands-free electronic device. The pocket further comprises an opening within the accessory article for supporting the pocket. The opening is dimensioned and contoured to support the electronic device. The pocket further comprises a first covering and a second covering dimensioned and contoured to support the electronic device. The second covering overlays the first covering and have a seamless attachment thereto with an edge being left unattached for receiving and removing the electronic device. Cut out openings extend through the base material of the accessory article and first covering1.

11 Claims, 12 Drawing Sheets

I-POCKET FOR AN ACCESSORY ITEM

This patent is a continuation-in-part of application Ser. No. 11/369,213 filed Mar. 6, 2006 now U.S. Pat. No. 7,992,225

BACKGROUND

This invention relates to an article for securing a small hands free electronic sound recording device. More particularly this invention relates to a pocket for securing a hands free sound recording device. Exercise today is an important part of many people lives. Additionally people listen to sound devices in ever aspect of their lives. While people exercise and relax they like to listen to many devices such as radios, CD players, MP3 players and many other such sound recording devices. However while exercising and relaxing securing a hand free device becomes a difficult task to manage. This invention was designed to alleviate this problem.

DETAILED SPECIFICATION

Figure 1:
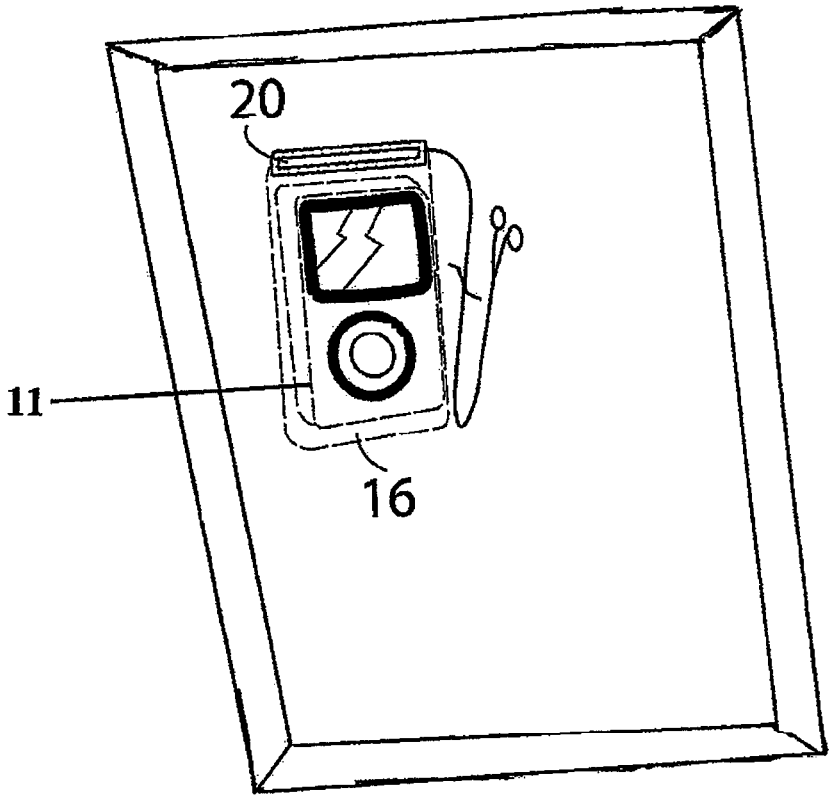
FIG. 1 is a frontal view of the present invention, pocket attached to an accessory item.
Figure 1A:
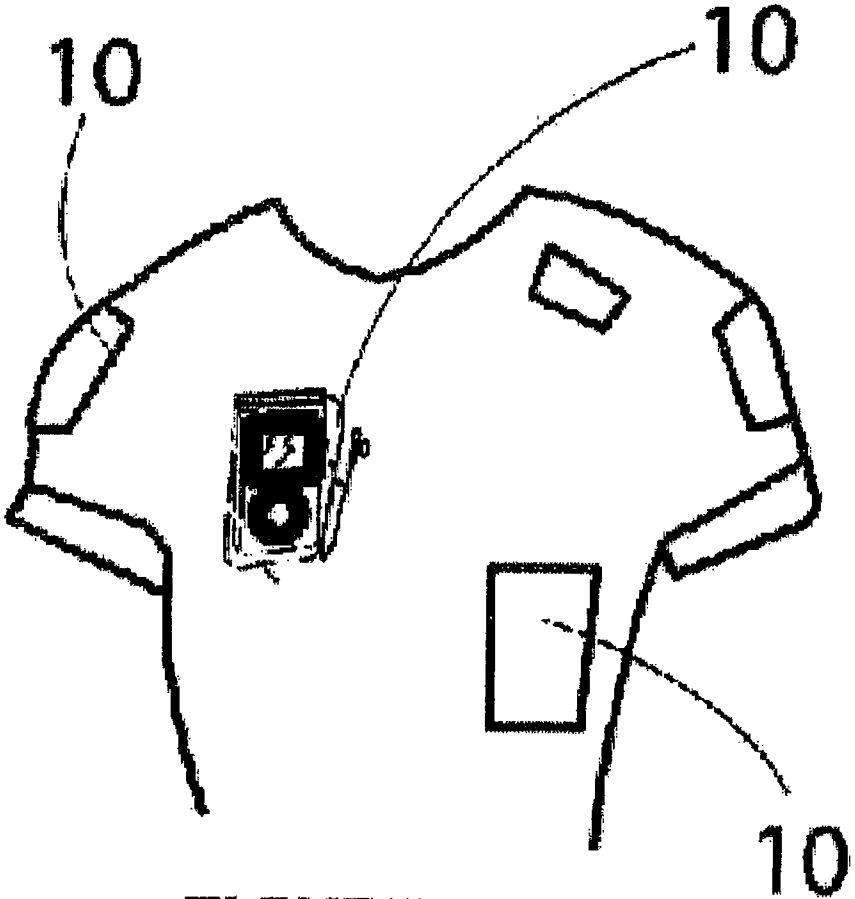
FIG. 1*a* is a frontal view of the present invention, pocket attached to a garment.

Referring to FIGS. 1 and 1A, there is shown a securing pocket (10) for a small hands-free electronic device attached to a accessory item such as a pillow, blanket, purse, apron, garment or hat. As shown in FIGS. 1 and 1A, pocket (10) which is dimensioned to the size and shape of the small electronic device (15) further comprises opening (20), covering1 (30), and covering2 (40). As depicted in FIG. 1, for illustration only, the hands free device (15) is rectangular in shape. Thus, pocket (10) is also rectangular in shape. However, it is to be understood that the invention may assume various alternative orientations and step sequences, unless it is expressly specified to the contrary. It is also to be understood that the specific devices and processes illustrated in the attached drawings and described in the following specification are simply exemplary embodiments of the inventive concepts defined in the appended claims: Hence, specific dimensions and other physical characteristics relating to the embodiments is disclosed herein are not to be considered as limiting, unless the claims expressly state otherwise.

Figure 2:
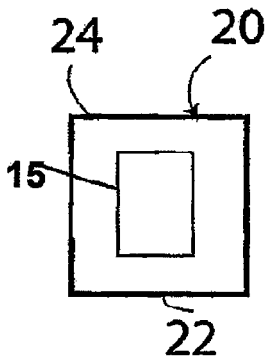
FIG. 2-2B is an illustration of accessory item opening, covering1, and covering2.
Figure 2A:
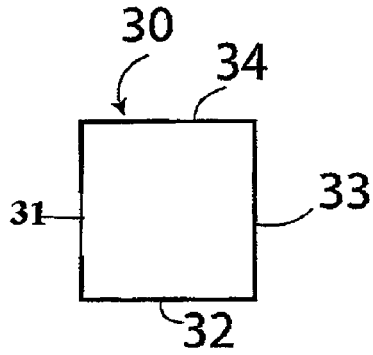
FIG. 2C is an illustration of the pocket container.
FIG. 2D is a top view illustration of opening 20 onto base material 106.
Figure 2B:
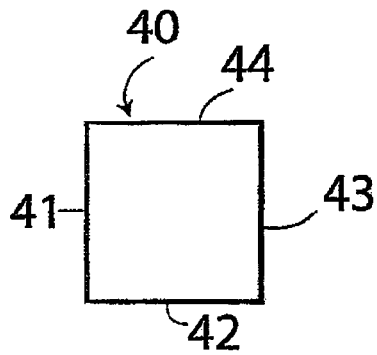

FIG. 2A illustrates an example of covering1 (30) and FIG. 2B illustrates an example of covering2 (40). Covering 1 (30) comprises bottom edge 32 and opposing side edges (31,33). Covering 2 (40) comprises bottom edge 42 and opposing side edges (41,43). As shown in FIG. 2*d*, the top edges (34, 44) of covering 1 and covering 2 seamlessly attach to opening 20 of base material 106 forming an entry way into pocket cavity 16 where the storage device is stored. FIG. 2 illustrates an example of opening (20) top view.

Figure 2C:
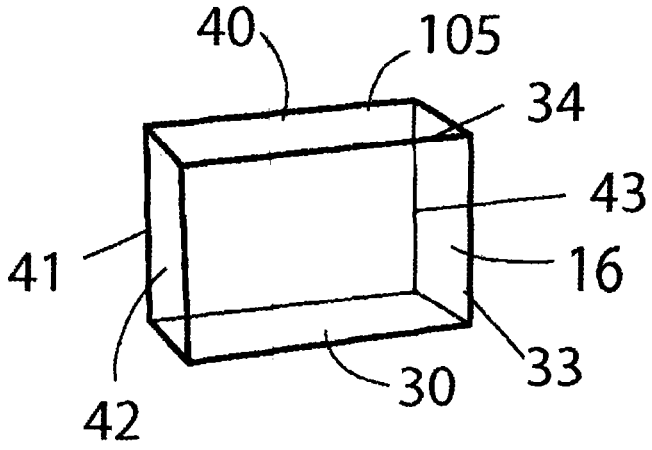
Figure 2D:
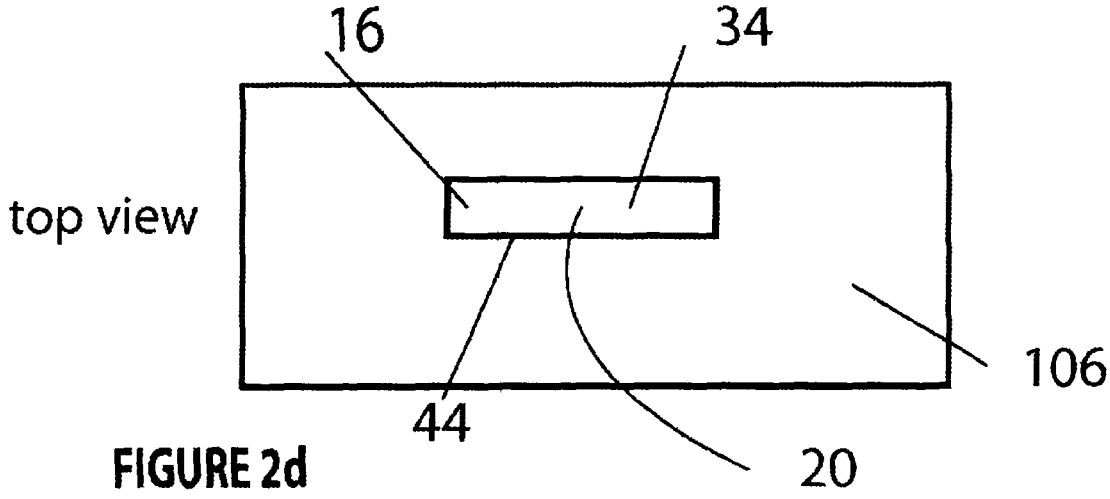
Figure 8:
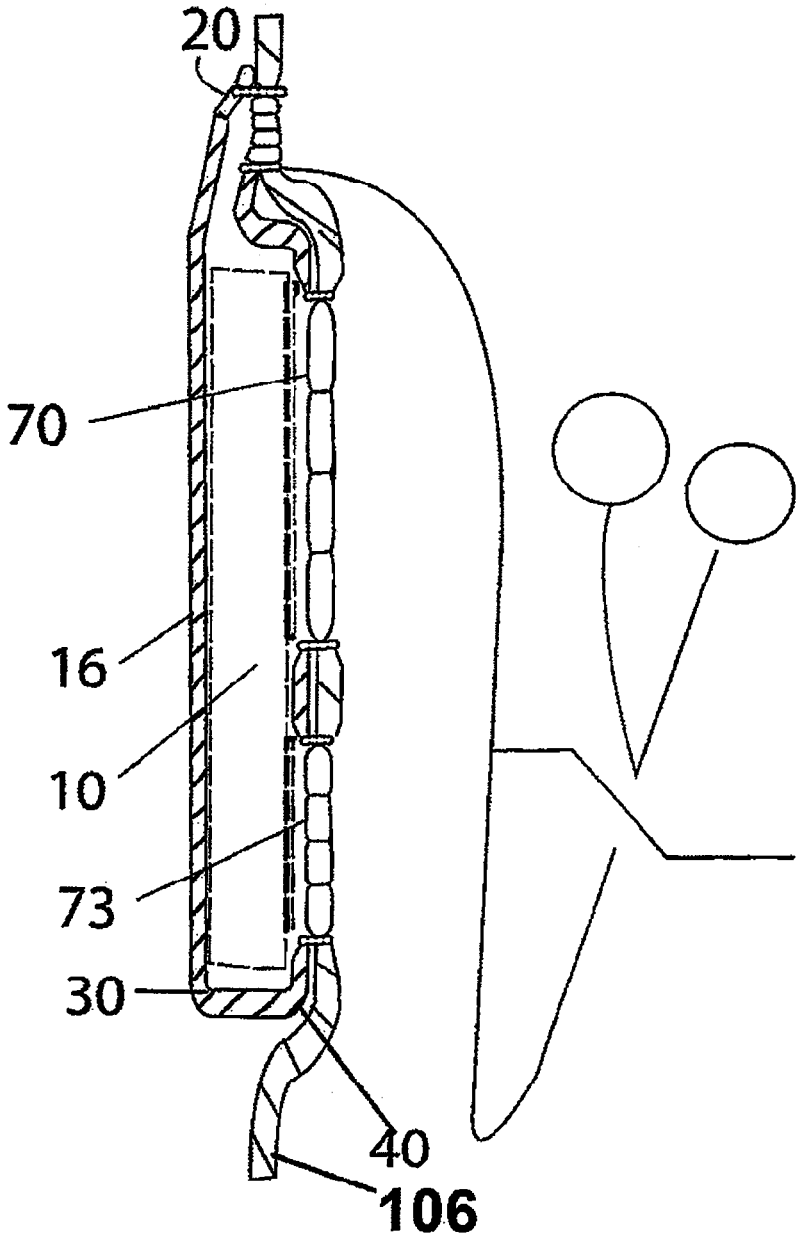
FIG. 8 shows alternative embodiment of pocket lying behind base fabric 106
Figure 9A:
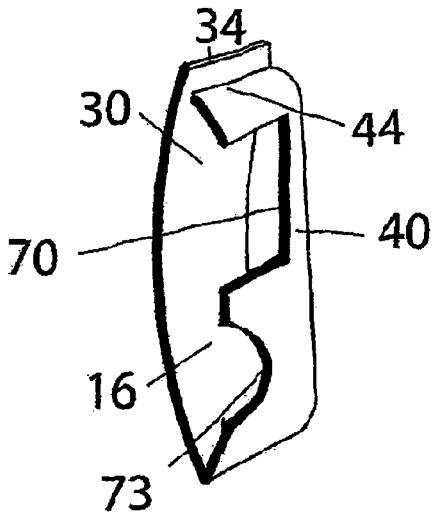
FIG. 9A illustrates a side cut away view of the pocket panels
Figure 9B:
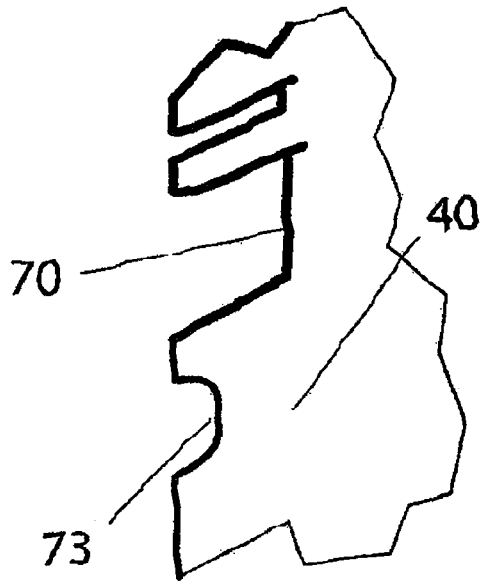
FIG. 9B illustrates a side cut away view of covering 2.

As shown in FIG. 2*c*, pocket cavity 16 is formed by overlaying covering 1 (30) with covering 2 (40) in the top edges directly attaches to opening (20) of base material (106). As shown in FIG. 8, the pocket 10 formed by overlaying covering 1 (30) and covering 2 (40) is disposed directly behind the base material (106) and extends there freely.

Figure 7:
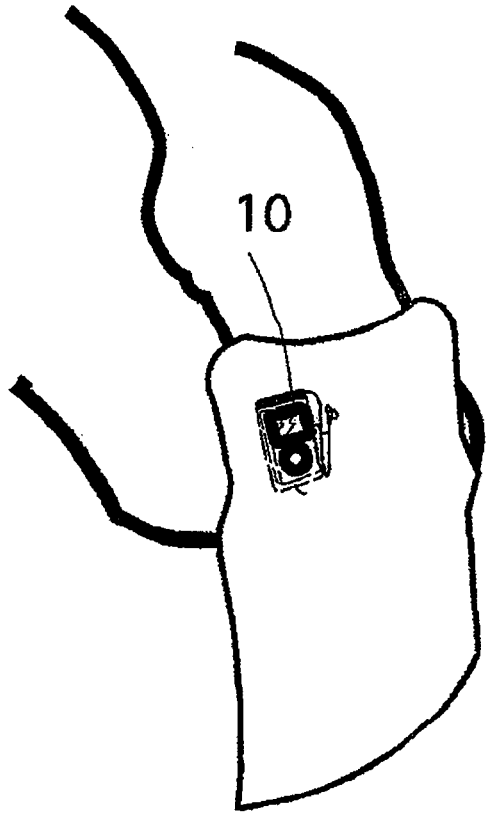
FIG. 7 is the pocket attached to an apron.
Figure 7A:
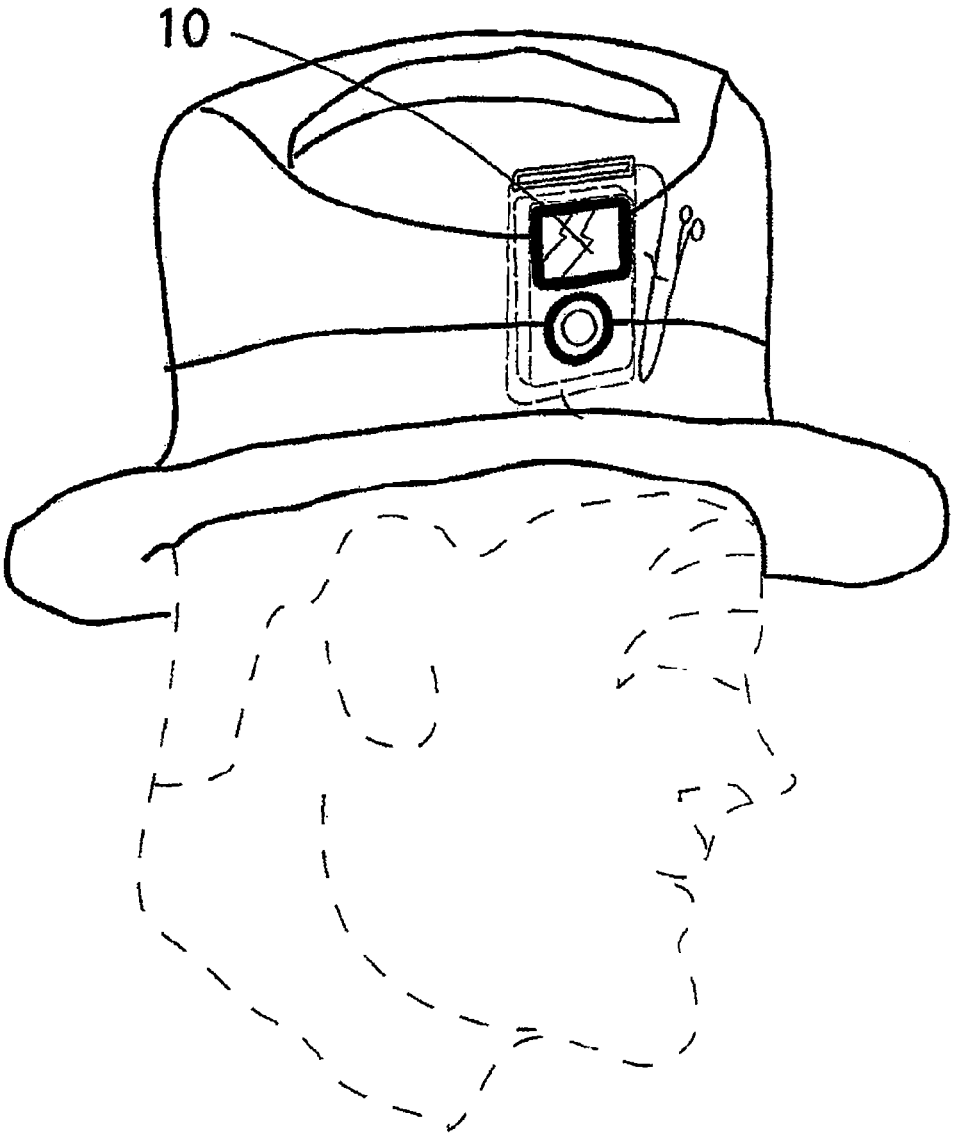
FIG. 7A is the pocket attached to a hat.
Figure 7B:
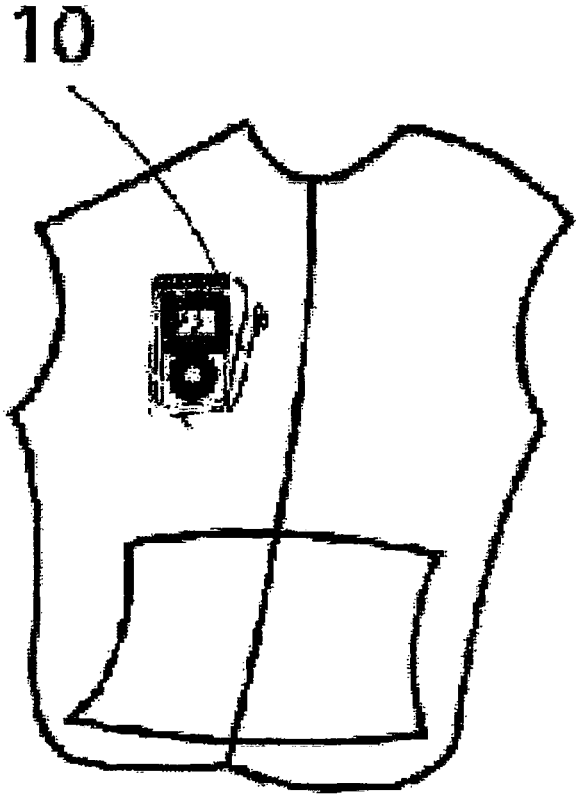
FIG. 7B is the pocket attached to a garment.

As depicted in FIG. 7B, pocket (10) can have a small capsule configuration for small accessory items. This configuration is particularly preferable for hats, caps, and other small accessory items as depicted in FIG. 7B.

Figure 3:
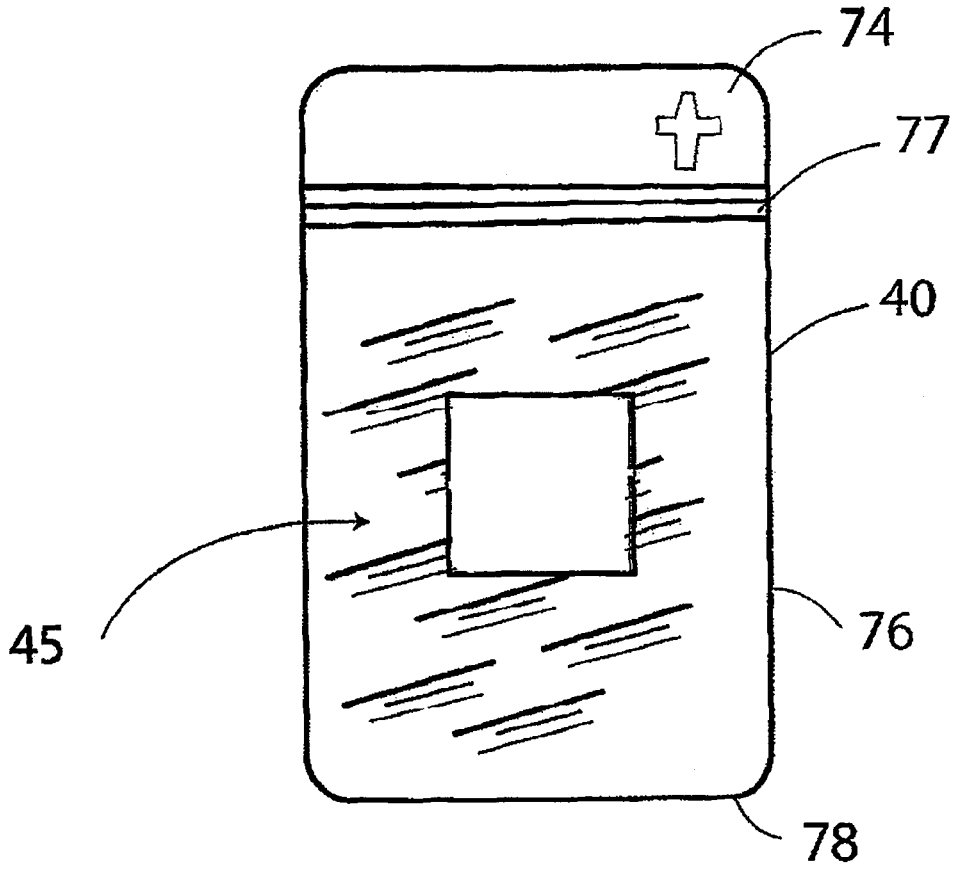
FIG. 3 is an internal surface area of covering2.

As depicted in FIG. 3, covering2 (40) can have an alternative embodiment. In this embodiment, covering2 (40) can further include upper flap1 (74) and lower flap2 (76). Upper flap1 (74) overlay lower flap2 (76) leaving opening (77) for entry of sound device into pocket (10) through opening 20.

Covering1 (30) further comprises an interior surface and an exterior surface area. Additionally, the dimensions for covering1 (30) can be slightly larger than opening (20) and covering 2 (40). The slightly larger dimensions of covering 1 (30) allows the exterior surface area of covering1 (30) to be pushed inwardly behind the base material of the accessory item forming a cavity (16) for receiving the device (15) as shown in FIG. 1. When device (15) is placed inside the cavity (16), the interior surface area of covering1 (30) hangs freely behind the base material of the accessory item as depicted in FIG. 1. Covering1 (30) can be made from a breathable material.

Referring to FIG. 3, covering2 (40) further comprises an exterior surface area and an interior surface area. Fastening means can be attached to the interior surface area of covering2 (40). Fastening means can cover the lower surface area, the peripheral edges of the interior surface area, or an elongated strip horizontally or vertically across the interior surface area. Fastening means (45) is pressed forward towards exterior surface area of covering1 (30). Fastening means (45) is adapted to securely and removeably attach to the exterior surface area of covering1 (30) as depicted in FIG. 1. Once fastening means (45) is pressed forward to securely attach to the exterior surface area of covering1 (30), the device is securely held in place in cavity (16). At this point, the pocket (10) provides a perfectly seamless look on the accessory item or garment.

Fastening means (45) is preferable made of the type of Velcro that does not require a mating member to be attached to the exterior surface area of covering1 (30). However, the exterior surface area of covering1 (30) can have a mate member having equivalent dimensions of fastening means (45) for receiving fastening means (45). As depicted in FIG. 8, covering2 (40) can further comprise at least one aperture adapted to receive the ear phones wires of device (15) there through.

Figure 4:
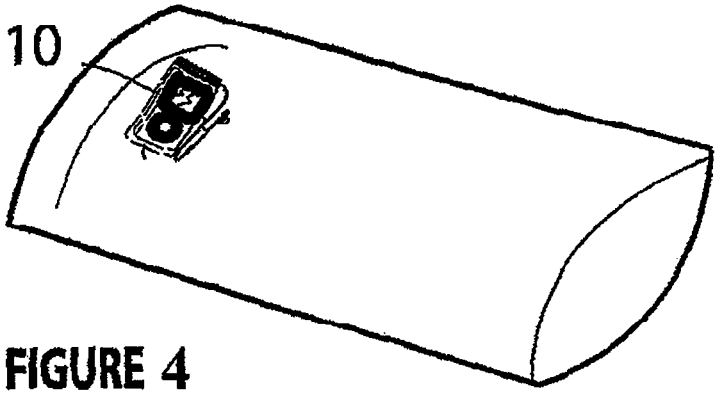
FIG. 4 is the pocket attached to a pillow.
Figure 5:
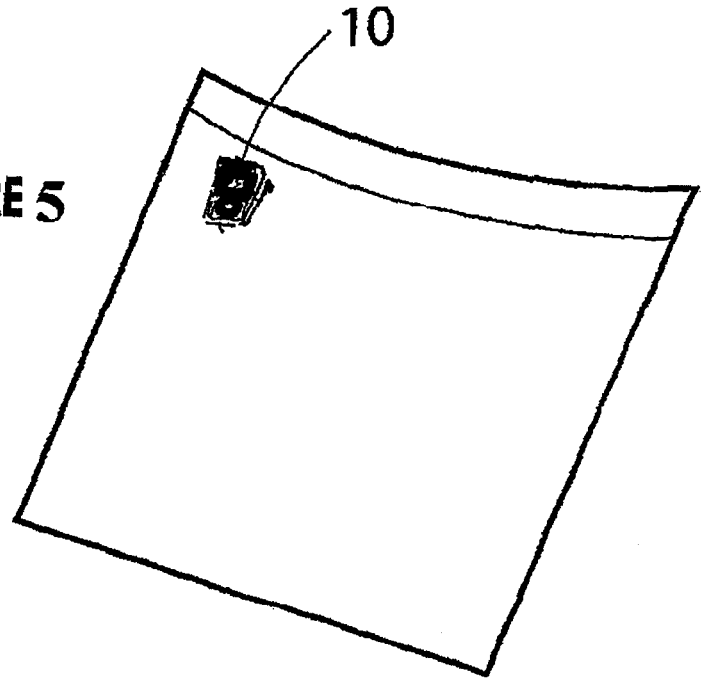
FIG. 5 is the pocket attached to a blanket.
Figure 6:
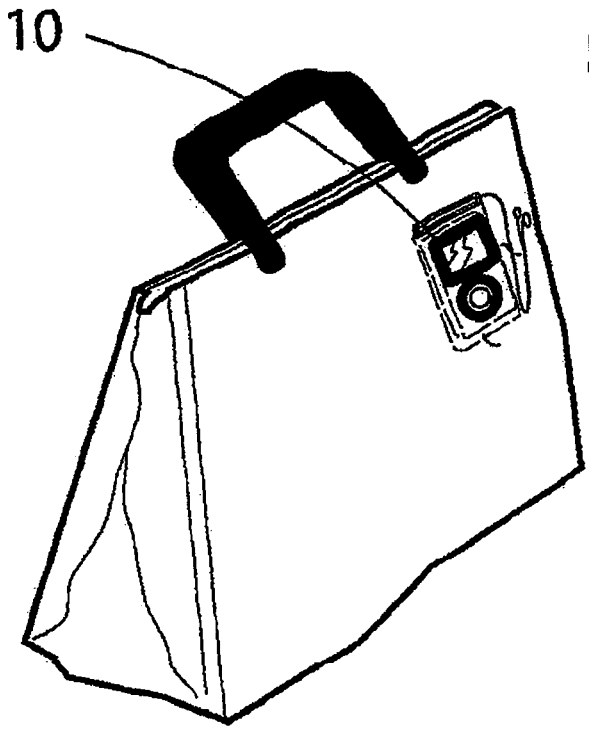
FIG. 6 is the pocket attached to a purse.
Figure 7C:
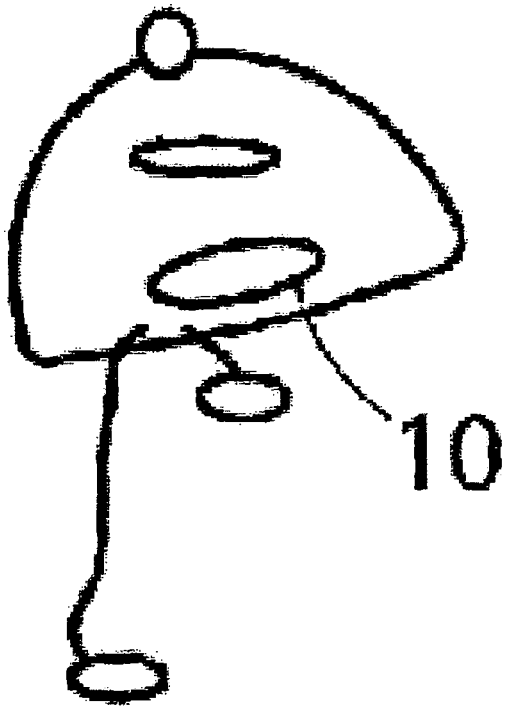
FIG. 7C is the pocket attached to a cap with multiple pockets.

Referring to FIGS. 4-7C, there is shown several types of accessory items or garments which the securing pocket can be attached to. Depicted in FIG. 4 is pocket (10) attached to a pillow. Depicted in FIG. 5 is pocket (10) attached to a blanket. Depicted in FIG. 6 is pocket (10) attached a purse. Depicted in FIG. 7A is pocket (10) attached to a hat. Depicted in FIG. 7B is pocket (10) attached to a garment. Additionally, multiple pockets can be attached to one accessory item as shown in FIG. 7C.

As shown in FIG. 8, pocket 10 is adapted with a cut out extending through the base material (106) and through opening to support sound devices that show videos, for example the Nano IPOD, the Shuffle IPOD, and the large IPOD. The Nano IPOD and the large IPOD show videos. The pocket 10 is adapted with a window (70) to support the video display or other supporting display. The pocket 10 can also be adapted with a second cut out opening (73) for the adjustment of the controls of the IPOD such as the controls for skipping, rewinding, fast forwarding, on/off, and other controls. Additionally, the pocket (10) can be adapted with a third cut through opening (74) extending through the base material is dimension to support the head phones of the sound device.

Covering1 and covering 2 can be made of mesh. The window 70 can be made of a transparent plastic material. Small opening 73 can also be made of a mesh material.

What is claimed is:

1. A securing pocket attached in a predetermined location to an accessory article or garment made of a base material for supporting small hands free electronic device, the pocket comprising: a first and a second pocket panel having bottom and sides edges that are attached together defining a pocket cavity with a top edge being unattached;

the second pocket panel includes a transparent window that extends through a cutout opening of the base material of the accessory article or garment and secured to an inner surface thereof;

the transparent window of the second pocket panel aligns with the cutout openings of the base material;

the top edge of the pocket cavity being seamlessly attached to the predetermined location on the base material wherein an entry opening is formed into the pocket cavity;

the entry opening forming a passageway for the insertion into and removal of the electronic device from the pocket cavity;

the first pocket panel and second pocket panel being positioned behind the base material extending linearly downward from the entry opening; and the first pocket panel being substantially spaced from the second pocket panel adapted to receive the electronic device through the entry opening from an interior of the accessory article.

2. The securing pocket of claim 1 further comprises a detachable flap positioned along the top edge of the pocket having means for fastening.

3. The securing pocket of claim 2 further comprises the means for fastening including Velcro.

4. The securing pocket of claim 1 further comprises the pair of transparent windows overlays a video display of the electronic device.

5. The securing pocket of claim 1 further comprises the second pocket panel is made of a mesh type of material.

6. The securing pocket of claim 1 further comprises the pair of transparent window is made of transparent plastic.

7. The securing pocket of claim 1 further comprises the second pocket panel includes a second transparent window extending through a second cut out opening that extends through base material, the second transparent window and being aligned over the second cut out opening and is disposed substantially in a predetermined location that corresponds to a location supporting a head phone of the electronic device.

8. The securing pocket of claim 1 further comprises the second pocket panel having an external surface area with a means for attaching to an interior surface of the first pocket panel.

9. The securing pocket of claim 8 wherein the means for attaching extends along an exterior surface area of the second pocket panel located below the cut out opening.

10. The securing pocket of claim 8 wherein the means for attaching extends along a peripheral edge surrounding an exterior surface area of second pocket panel.

11. The securing pocket of claim 8 wherein the fastening means is Velcro.

* * * * *